US006000178A

United States Patent [19]

Goodings

[11] Patent Number: 6,000,178

[45] Date of Patent: Dec. 14, 1999

[54] APPARATUS AND METHOD OF INSTALLATION OF A COMPOSITE BUILDING PANEL

[76] Inventor: Peter J. Goodings, 43 Colonnade Road, North York, Ontario, Canada, M2K 2L6

[21] Appl. No.: 08/631,728

[22] Filed: Apr. 11, 1996

Related U.S. Application Data

[63] Continuation-in-part of application No. 08/551,202, Oct. 31, 1995.

[51] Int. Cl.[6] ..... E04B 2/88

[52] U.S. Cl. ..... 52/235; 52/385; 52/403.1

[58] Field of Search ..... 52/384, 385, 309.8, 52/523, 525, 539, 747.1, 747.11, 748.1, 748.11, 409, 403.1, 588.1, 579, 630, 796.1

[56] References Cited

U.S. PATENT DOCUMENTS

| | | | |
|---|---|---|---|
| 90,924 | 1/1905 | Fisher . | |
| 1,966,041 | 7/1934 | Nelson . | |
| 2,120,195 | 6/1938 | Valenti . | |
| 3,303,620 | 2/1967 | Dawson . | |
| 3,473,274 | 10/1969 | Godes | 52/409 |
| 4,292,781 | 10/1981 | Chalmers et al. | 52/409 X |
| 4,320,613 | 3/1982 | Kaufman | 52/309.8 X |
| 4,506,482 | 3/1985 | Pracht | 52/235 |
| 4,631,891 | 12/1986 | Donavich | 52/588 |
| 4,783,941 | 11/1988 | Loper | 52/235 |
| 4,890,433 | 1/1990 | Funaki | 52/386 |
| 5,065,553 | 11/1991 | Magid | 52/409 X |
| 5,085,022 | 2/1992 | Paliwoda | 52/309.8 |
| 5,165,213 | 11/1992 | Finch | 52/589 |
| 5,311,716 | 5/1994 | Houssin | 52/410 |
| 5,337,529 | 8/1994 | Lutin et al. | 52/384 X |
| 5,465,543 | 11/1995 | Seifert | 52/309.8 |
| 5,494,261 | 2/1996 | Gandara | 256/24 |

FOREIGN PATENT DOCUMENTS

| | | |
|---|---|---|
| 385572 | 7/1934 | Canada . |
| 686819 | 5/1964 | Canada . |
| 2022601 | 8/1990 | Canada . |
| 2072413 | 6/1992 | Canada . |

*Primary Examiner*—Beth Aubrey
*Attorney, Agent, or Firm*—McAulay Nissen Goldberg Kiel & Hand, LLP

[57] ABSTRACT

A new and useful apparatus for use in the installation of a composite building panel. The apparatus comprises a corrugated member adapted to be adhered to the panel to form a back face of the panel when so adhered, anchor integral with the corrugated member and extending longitudinally from an upper portion of the corrugated member and lock integral with the corrugated member and extending longitudinally from a bottom portion of the corrugated member. The lock engageable with the anchor of an adjacent panel has the corrugated member as a back face.

11 Claims, 6 Drawing Sheets

APPARATUS AND METHOD OF INSTALLATION OF A COMPOSITE BUILDING PANEL

REFERENCE TO RELATED CASES

This application is a continuation-in-part of U.S. patent application Ser. No. 08/551,202 filed Oct. 31, 1995, entitled "Apparatus and Method of Installation of a Composite Building Panel" by the same inventor herein.

FIELD OF THE INVENTION

This application relates to an apparatus and method for use in the installation of composite building panels.

BACKGROUND OF THE INVENTION

Builders and home owners are frequently looking for just the right exterior surface for their buildings. Currently, however, the choice of finishing systems available is fairly restrictive. Two of the more popular choices in tenus of appearance are brick and stone. However, natural stone is simply too expensive for use on anything other than a small number of applications where the market can bear the cost. Even brick has become too expensive for the low and middle class housing market. As such, builders typically look to cheaper vinyl and aluminum siding as the alternative. However, those materials are rarely considered as pleasing exterior finishes. Therefore, there exists a demand for an affordable alternative product, one which is aesthetically pleasing, requires little maintenance and, most of all, is easy to install, either during the building stage or as a renovation project.

In its co-pending Canadian Patent Application Ser. No. 2,107,847, applicant describes a composite building panel which meets this demand. The present invention is related to an apparatus for use in the installation of a composite building panel such as that described in applicant's co-pending Canadian patent application and to a method of using that apparatus in the installation of such a panel.

The prior art describes apparatus and methods of installing a variety of sheet wall panelling, building tiles and concrete slabs using discrete clips and adhesives. Reference is made for example to U.S. Pat. No. 2,120,195, of Valenti, issued Jun. 7, 1938, U.S. Pat. No. 90,924 of Fisher issued Jan. 12, 1905, Canadian Patent No. 686,819 of Medow, issued May 19, 1964, Canadian Patent No. 385,572 of Wardle, issued Apr. 19, 1939 and Canadian laid-open Patent Application Ser. No. 2,022,601 of Francis, filed, Aug. 2, 1990. However, none of these references is directed towards an apparatus and method capable of use in the installation of a composite building panel similar to that of applicant's co-pending Canadian patent application.

SUMMARY OF THE INVENTION

In one aspect of the invention there is provided an apparatus for use in the installation of a composite building panel. The apparatus comprises a corrugated member discrete from but adapted to be adhered to the panel to form a back face of the panel when so adhered the corrugated member having an outside wall engaging the face and an inside panel engaging face, anchor means integral with the corrugated member and extending longitudinally from an upper portion of the corrugated member and locking means integral with the corrugated member and extending longitudinally from a bottom portion of the corrugated member. The locking means is engageable with the anchor means of an adjacent panel having the corrugated member as a back face.

In another aspect of the invention, there is provided a track adapted to be mounted to the wall, which track includes a flange-receiving groove.

In another aspect of the invention, there is provided at least one stiffener fastened to an inner surface of the corrugated member such that the stiffener extends within the panel when the corrugated member is adhered to the panel.

BRIEF DESCRIPTION OF THE DRAWINGS

These and other advantages of the invention will become apparent upon reading the following detailed description and upon referring to the drawings in which.

Figure 1:
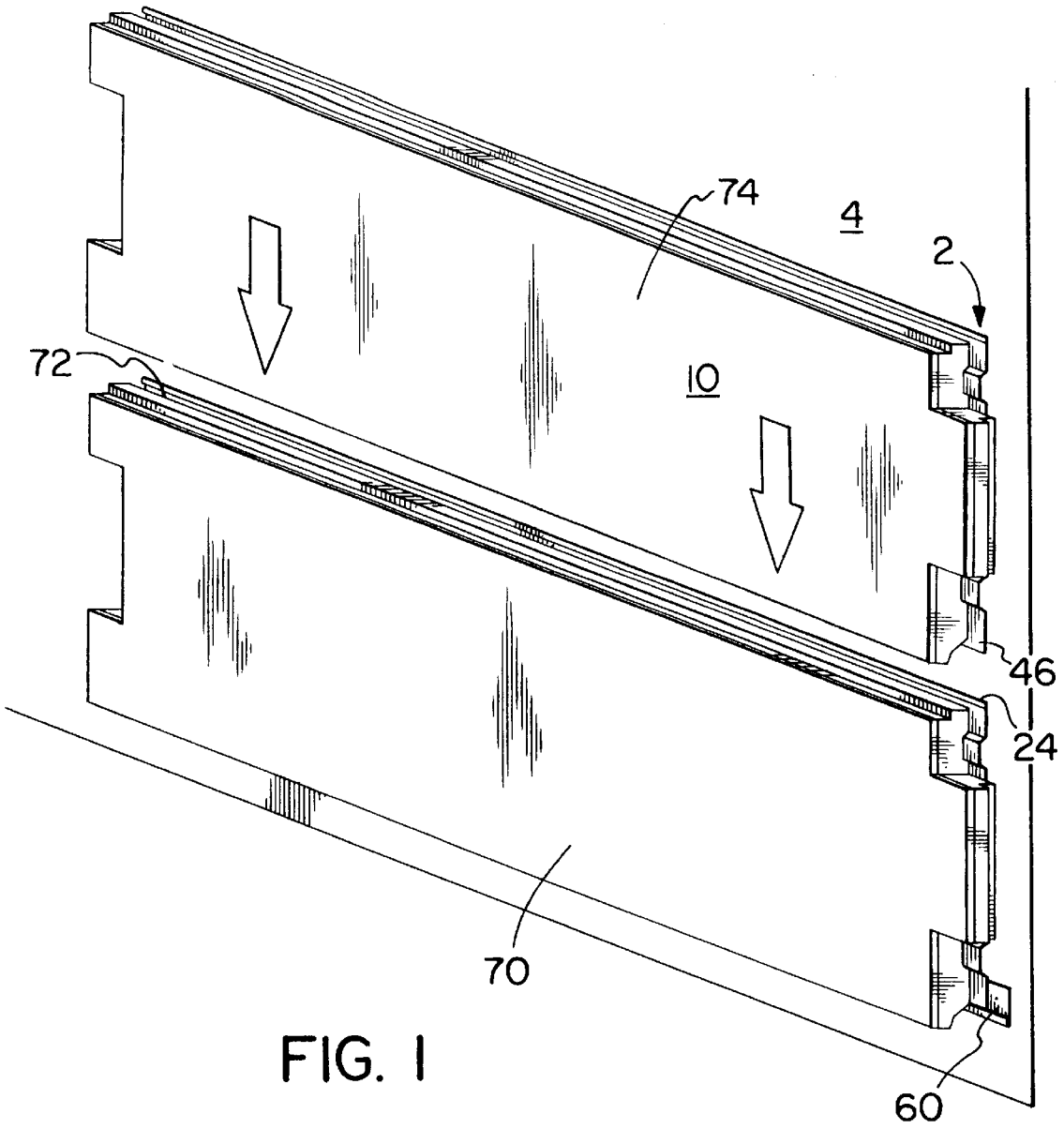
FIG. 1 is a perspective view of a wall incorporating the apparatus and composite building panels in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, FIG. 1 illustrates an apparatus 2 for use in the installation to a wall 4 of a composite building panel 10. The panel 10 is preferably of the type described in applicant's co-pending Canadian Patent Application Ser. No. 2,107,847.

Figure 2:
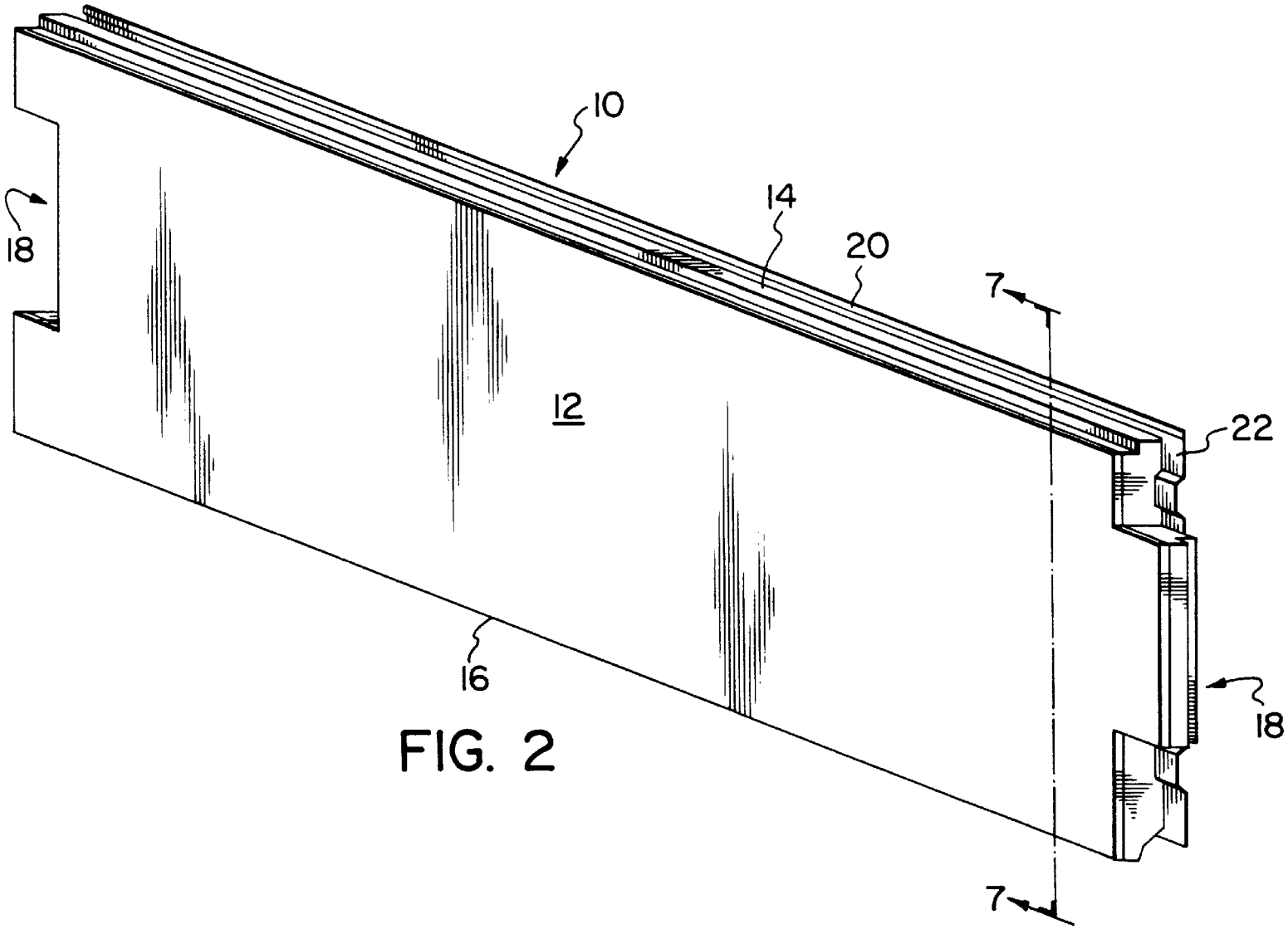
FIG. 2 is a perspective view of a panel incorporating the apparatus of the present invention.

With reference to FIG. 2, the panel 10 comprises a front face 12, a top edge 14, a bottom edge 16, side edges 18 and a back face 20 formed by the corrugated member 22.

Figure 3:
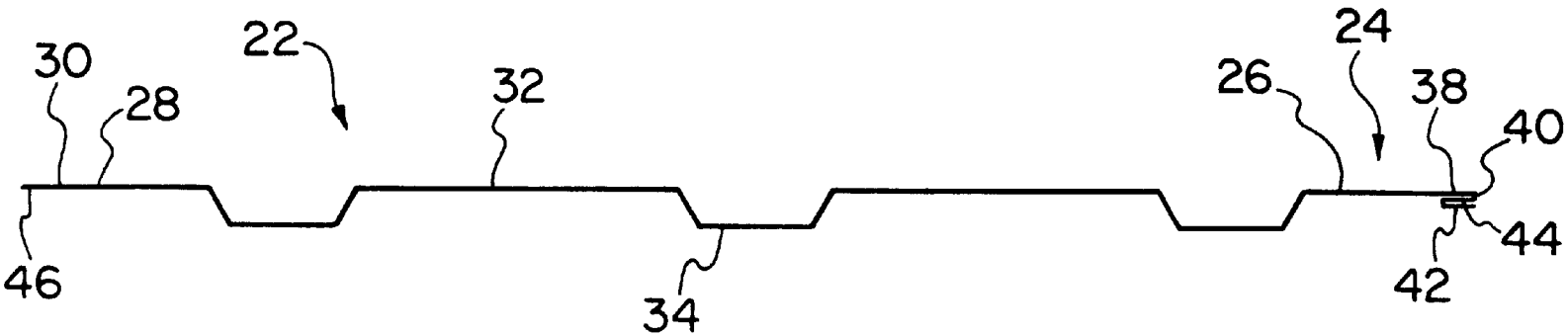
FIG. 3 is a side plan view of the corrugated member of the present invention.
Figure 4:
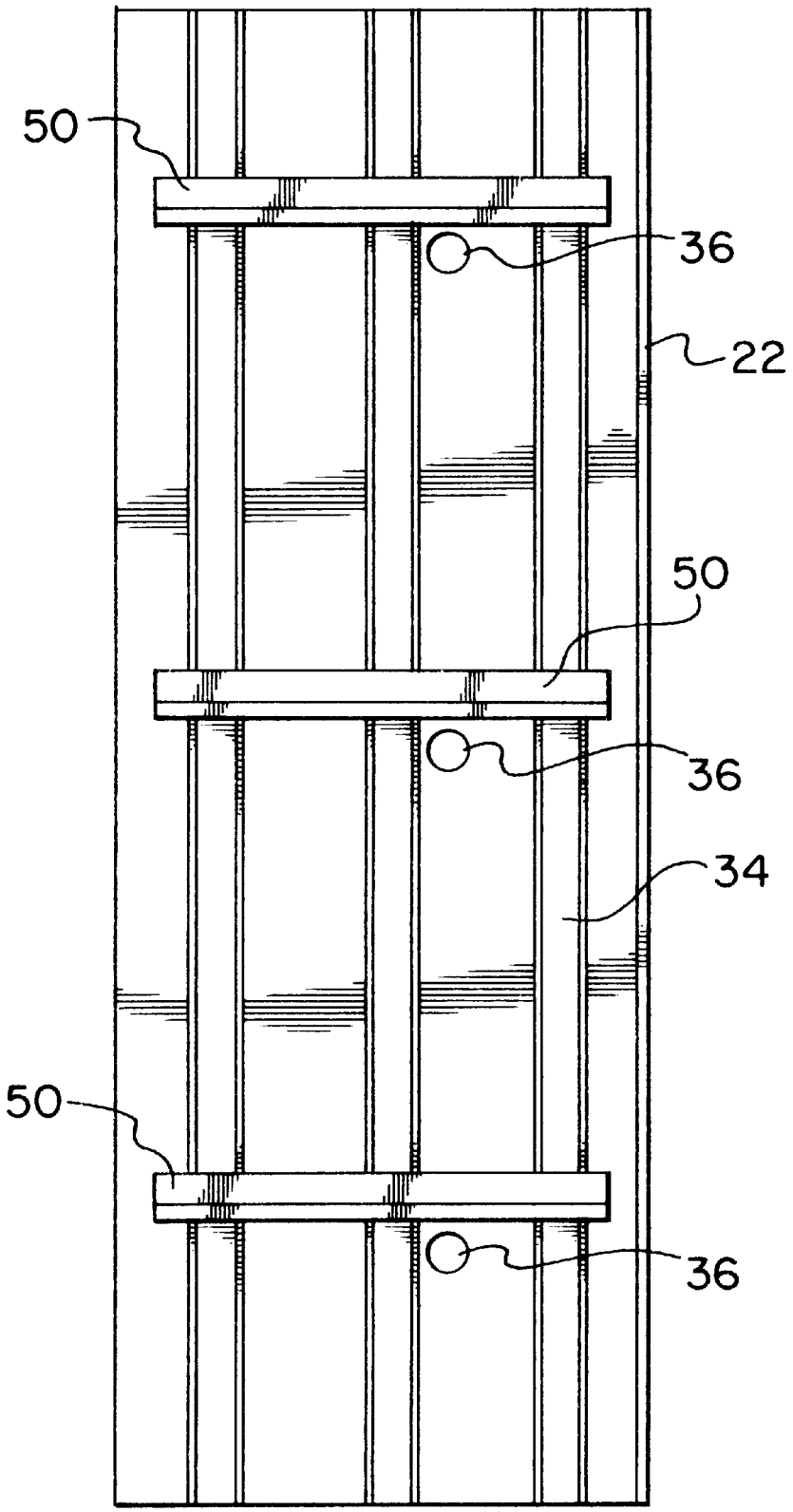
FIG. 4 is a plan view of the inside surface of the corrugated member of the present invention.

With reference to FIGS. 3 and 4, the corrugated member 22 is an elongated member preferably manufactured of galvanized steel, adapted to be adhered to the panel 10 to form the back face 20 of the panel 10. Integral with the member 22 there is provided anchor means 24 extending longitudinally from an upper portion 26 of the member 22. Preferably, the anchor means 24 extends beyond the top edge 14 of the panel 10 when the member 22 is adhered to the panel 10. Integral with the member 22 and extending longitudinally from a lower portion 28 of the member 22, there is provided a locking means 30 which preferably extends beyond the bottom edge 16 of the panel 10 when the member 22 is adhered to the panel 10. The locking means 30 is configured so as to be engageable within the anchor means 24 of a vertically adjacent panel 10 having the corrugated member 22 adhered thereto as back face 20.

The corrugated member 22 is defined by alternating wall engaging faces 32 and panel engaging faces 34 along its length. There may also be provided adherence sites 36 through which adherence of the member 22 to the panel 10 may be effected. As described in applicant's co-pending Canadian Patent Application Ser. No. 2,107,847, the panel 10 is preferably filled with foamed insulating material. This material may be injected into the panel 10 through adherence sites 36 of member 22 when member 22 is placed in position relative panel 10 as a back face 20. Thus, the insulating foam will fill the inside of the panel 10, surrounding the panel engaging faces 34 of member 22 holding the member 22 in place as back face 20.

The anchor means 24 is defined by a plurality of elongated strips.

The first strip 38 extends longitudinally from the member 22. The second strip 40 curves about 180 degrees and extends longitudinally in a direction opposite to the first strip 38 for less than the length of the first strip 38. The third strip 42 curves 180 degrees relative the second strip to extend longitudinally to finish in a plane parallel to the end of the first strip 38. Thus, the space between the second strip 40 and the third strip 42 defines a flange-receiving channel 44. There may also be provided fastening means (not shown), located within a mid-portion of said first strip 38, for mounting the member 22 to the wall 4.

The locking means 30 is a flange 46 extending from the lower portion 28 of the member 22, such that it may extend beyond the bottom edge 16 of panel 10, when member 22 is in position as back face 20, or may be offset from the bottom edge 16 as shown in FIG. 2. The flange 46 is oriented to engage within flange-receiving channel 44 when a first panel is vertically adjacent a second panel, each panel having a member 22 as a back face 20.

Figure 5:
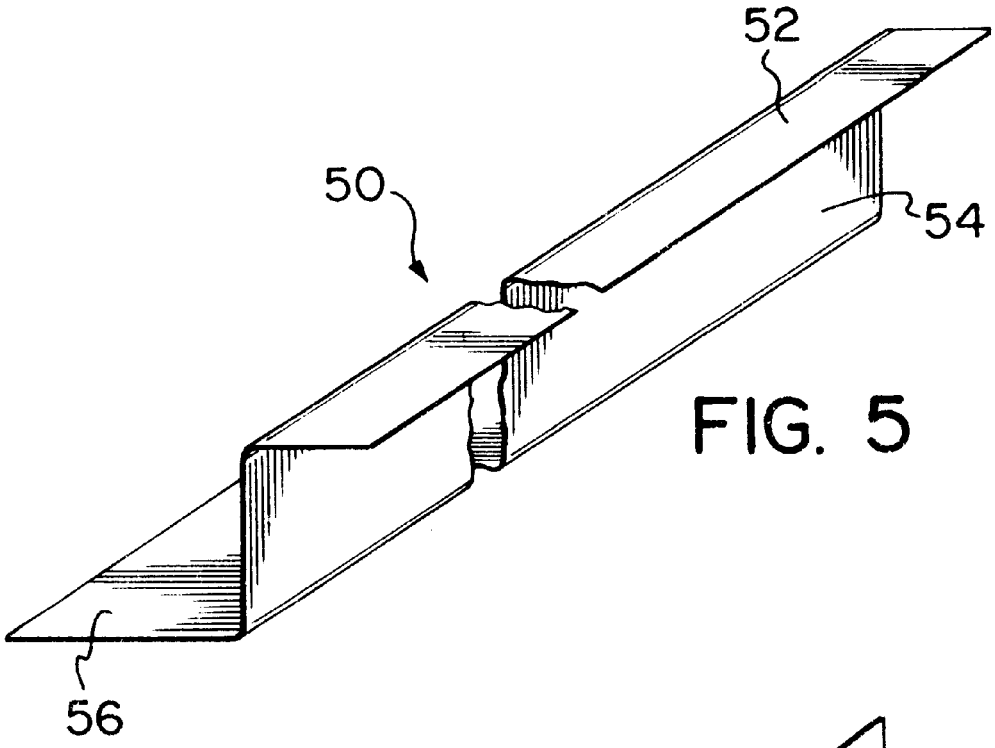
FIG. 5 is a perspective view, partially cut away, of the stiffeners to be fastened to the apparatus in accordance with the present invention.

Fastened to the inside surface 48 of member 22, there may also be provided at least one elongated stiffener 50. As illustrated in FIG. 5, the stiffener 50 has a Z-shaped configuration and may comprise a plurality of elongated strips secured together in Z-shaped configuration or may be a single elongated strip formed into a Z-shape. The first strip or face 52 is oriented to abut a portion of inside surface 48 and be fastened thereto through conventional means, such as spot welding, riveting and the like. The remaining strips or faces 54, 56 of stiffener 50 are oriented to extend within panel 10 when the member 22 is in place as back face 20 to provide holding power of the member 22 within the panel 10 and to provide increased rigidity and torsional stability of the member 22 relative the panel 10 and the wall 4. As discussed above, when the panel is filled with foamed insulating material, that material will adhere to the inside surface of the corrugated member 22. The foamed material will also adhere to the stiffener 50 to provide extra holding force and torsional stability.

Figure 6:
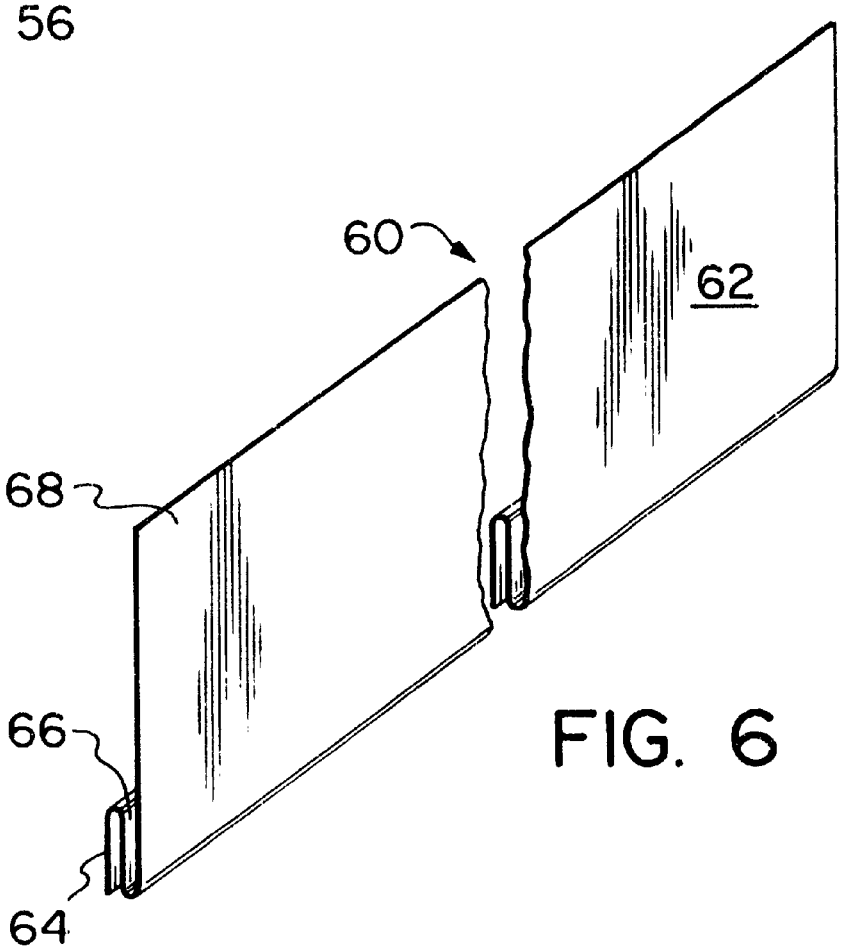
FIG. 6 is a perspective view, partially cut away, of the track means in accordance with the present invention.

There may also be provided J-shaped track means 60, shown in FIG. 6, comprising an elongated upstanding wall mounting face 62 and at least one elongated strip 64 to define a flange-receiving channel 66, similar in configuration to that of anchor means 24. There may also be provided fastening means (not shown) to mount the track means 60 to the wall 4. Further, there may be provided a lateral offset (not shown) within a top portion 68 of wall mounting face 62 in a direction opposite the orientation of the flange-receiving channel 66.

Figure 7:
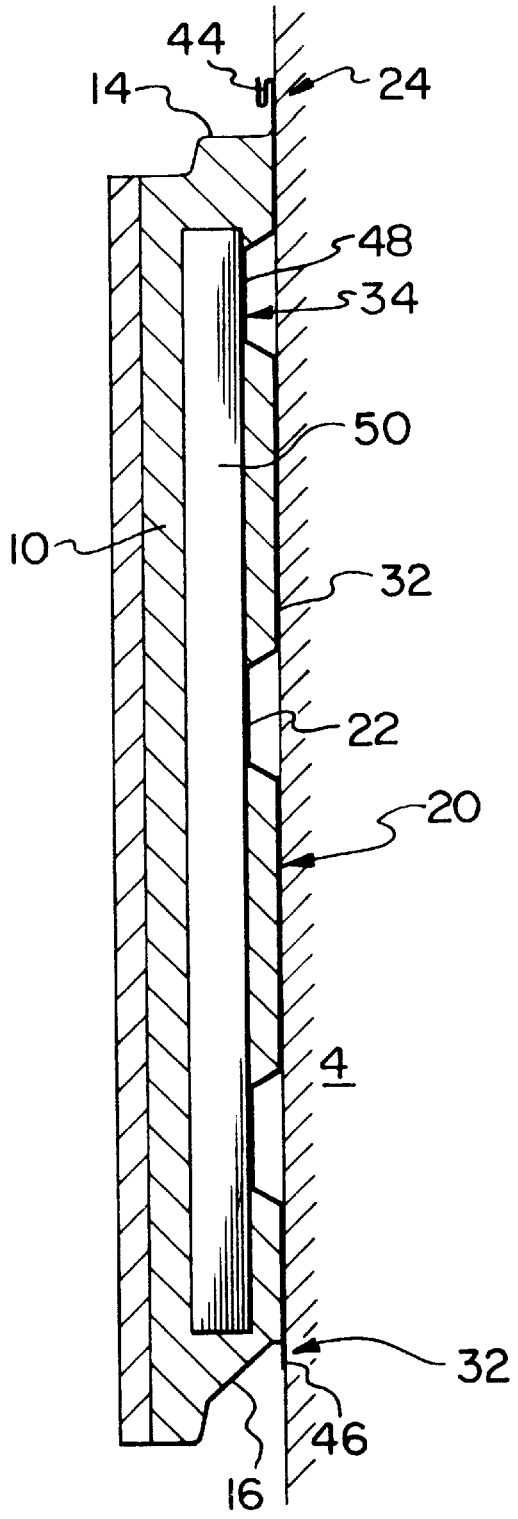
FIG. 7 is a cross-sectional view of the invention taken along line 7—7 of FIG. 2.

As seen in FIG. 7, when the member 22 is adhered to the panel 10 to form back face 20, the anchor means 24 extends beyond the top edge 14 and the flange 46 of locking means 30 may be offset from the bottom edge 16. The stiffeners 50 are fastened to the member 22 along inside surface 48, by means of a spot weld, for example, to abut panel engaging face 34 of member 22 and extend within the panel 10.

The method of using apparatus 2 to install a plurality of panels 10 is to fasten a first panel 70 at a first position along the wall 4 with a plurality of fasteners 72 spaced evenly along the length of the panel 10. Preferably, track means 60 is fastened to the wall 4 to receive panel 10 by means of engaging flange 46 into flange-receiving channel 66. A plurality of panels 70 may then be secured to the track means 60 and installed in side-by-side relation (not shown). There is thus created a first row of panels. A second panel 74, incorporating apparatus 2 is then presented to the wall 4 in vertically adjacent orientation to first panel 70 such that the flange 46 of second panel 74 is in mating relation with the flange-receiving channel of anchor means 24 of first panel 70. A plurality of panels 74 may be secured in position in the same manner thus creating a second row of panels. This process is then repeated as required to completely cover the building exterior, as desired by the user.

Thus, it is apparent that there has been provided in accordance with the invention an apparatus and method for use in the installation of a composite building panel that fully satisfies the objects, aims and advantages set forth above. While the invention has been described in conjunction with example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim as my invention:

1. An apparatus for use in the installation of a composite building panel, said apparatus comprising:

a corrugated member discrete from and adapted to be adhered to said composite building panel to form a back face of aid panel when so adhered, said corrugated member having an outside wall engaging face and an inside panel engaging face;

anchor means integral with said corrugated member and extending longitudinally from an upper portion of said corrugated member;

locking means integral with said corrugated member and extending longitudinally from a lower portion of said corrugated member;

said locking means engageable with an anchor means of an adjacent panel having a corrugated member as a back face; and at least one elongated stiffener fastened to said panel engaging face of said corrugated member such that said stiffener extends within said panel when said corrugated member is adhered to said panel.

2. The apparatus of claim 1 wherein said anchor means includes fastening means to mount said corrugated member to a wall.

3. The apparatus of claim 1 introducing J-shaped track means adapted to be mounted to a wall, said track means comprising a flange-receiving channel to receive said locking means of said corrugated member.

4. The apparatus of claim 3 wherein said track means comprises an elongated upstanding wall-mounting face and at least one elongated strip to form said flange receiving channel.

5. The apparatus of claim 1 wherein said elongated stiffener is Z-shaped.

6. The apparatus of claim 2 or claim 3 wherein said anchor means comprises a flange-receiving channel.

7. The apparatus of claim 6 wherein said locking means is a flange extending from an edge of said corrugated member.

8. The apparatus of claim 7 wherein said flange of said corrugated member is adapted to be mounted to the panel mates with a flange-receiving channel of said corrugated member mounted to a second panel, said second panel longitudinally adjacent said first panel.

9. In combination, a building panel;

a corrugated member adhered to said panel to form a back face of said panel, said corrugated member having an outside wall engaging face and an inside panel engaging face;

anchor means integral with said corrugated member and extending longitudinally from an upper portion of said corrugated member;

locking means integral with said corrugated member and extending longitudinally from a lower portion of said corrugated member;

said locking means engageable with an anchor means of an adjacent panel having a corrugated member as a back face; and at least one elongated stiffener fastened to a surface of said corrugated member such that said stiffener extends within said panel.

10. The panel of claim 9 wherein said panel is filled with foamed insulating material which adheres to said corrugated member and said stiffener.

11. A method of installing a plurality of composite building panels to a wall comprising the steps of:

fastening at least one elongated stiffener to an inside surface of each of a plurality of corrugated members;

adhering one of said corrugated members to each of said panels to form a back face of each of said panels such that said stiffener extends within said panel, said corrugated member having anchor means comprising a flange-receiving channel and locking means comprising a flange extending from an edge of said corrugated member;

mounting a track means to said wall and mounting a first of said panels to said track means such that intermittent portions of said corrugated member adhered to said first of said panels are in contact with said wall; and presenting a second of said panels to said wall longitudinally adjacent said first panel such that said flange of said second panel engages within said flange-receiving channel of said first panel.

* * * * *

UNITED STATES PATENT AND TRADEMARK OFFICE

CERTIFICATE OF CORRECTION

PATENT NO. : 6,000,178

DATED : December 14, 1999

INVENTOR(S) : Peter J. Goodings

It is certified that error appears in the above-identified patent and that said Letters Patent is hereby corrected as shown below:

Column 1, line 19, change "tenus" to -terms-

Column 4, line 38, change "aid" to -said-

Signed and Sealed this

Twentieth Day of June, 2000

*Attest:*

Q. TODD DICKINSON

*Attesting Officer*

*Director of Patents and Trademarks*